US006425731B2

(12) United States Patent
Focke et al.

(10) Patent No.: US 6,425,731 B2
(45) **Date of Patent: *Jul. 30, 2002**

(54) APPARATUS FOR HANDLING REELS

(75) Inventors: Heinz H. Focke, Verden; Wolfgang Gropp, Daverden, both of (DE)

(73) Assignee: Focke & Co. (GmbH & Co.), Verden (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/027,253

(22) Filed: Feb. 20, 1998

(30) Foreign Application Priority Data

Mar. 4, 1997 (DE) ..... 197 08 552

(51) Int. Cl.[7] ..... B66C 1/42

(52) U.S. Cl. ..... 414/729; 414/769.9; 414/908; 414/910

(58) Field of Search ..... 414/680, 729, 414/796.9, 908, 910; 294/97, 93, 94, 95, 907, 66.2, 67.22; 242/605

(56) References Cited

U.S. PATENT DOCUMENTS

| | | | | |
|---|---|---|---|---|
| 1,356,120 A | * | 10/1920 | Bassisty | 242/605 X |
| 2,192,358 A | | 3/1940 | Lieber | |
| 2,768,019 A | | 10/1956 | Brooks | |
| 2,841,300 A | * | 7/1958 | Berquist | 414/908 X |
| 3,104,126 A | * | 9/1963 | Lovash | 294/97 |
| 4,199,183 A | * | 4/1980 | Hecker | 294/97 |
| 4,383,795 A | * | 5/1983 | Wakamatsu | 414/796.9 X |
| 4,573,725 A | * | 3/1986 | Griffiths | 294/66.2 X |
| 4,685,711 A | * | 8/1987 | Zuber | 294/67.22 X |
| 4,708,574 A | * | 11/1987 | Conboy et al. | 294/95 X |
| 4,723,884 A | | 2/1988 | Brinker et al. | |
| 4,872,718 A | * | 10/1989 | Nerger | 294/907 X |
| 5,067,013 A | * | 11/1991 | Lindholm et al. | 294/66.2 X |
| 5,490,702 A | * | 2/1996 | Fleming | 294/97 |
| 5,827,594 A | * | 10/1998 | Chan | 242/605 X |

FOREIGN PATENT DOCUMENTS

| | | |
|---|---|---|
| BE | 751 658 | 11/1970 |
| DE | 2136791 | 2/1973 |
| DE | 2440666 | 3/1976 |
| DE | 3202647 | 9/1982 |
| DE | 3318994 | 11/1984 |
| DE | 3342080 | 5/1985 |
| DE | 3342204 | 5/1985 |
| DE | 3501692 | 7/1986 |
| DE | 87 08 511 | 8/1987 |
| DE | 3631205 | 3/1988 |

(List continued on next page.)

OTHER PUBLICATIONS

Kleinschnittger, Andread; THIEMANN, Peter: Anspruchsvoller Automatikkram. In; F+H Forden und Heben 44, 1994, nr. 6, S. 450,452

Hesse, Wilhelm: Technik und Anwendung automatisierter Krane. In: Hebezeuge und Fordermittel, Berlin 35, 1995, 12, S. 521–524

*Primary Examiner*—Donald W. Underwood
(74) *Attorney, Agent, or Firm*—Sughrue Mion, PLLC

(57) ABSTRACT

A bearing journal (21), which is introduced into a central opening (22) in the reel (10) and is anchored releasably inside a reel core (11), serves for automatically receiving reels (10). Provided for the connection between the bearing journal (21) and the reel core (11) are clamping webs (23) which are extended laterally and take up a connection with the inner side of the reel core (11) in a non-positive and/or positive-locking manner. The bearing journal (21) is provided with a plurality of mechanical monitoring members which indicate any incorrect position of the bearing journal (21). The movements of the bearing journal (21) are controlled automatically by means of a camera (38).

9 Claims, 5 Drawing Sheets

FOREIGN PATENT DOCUMENTS

| | | |
|---|---|---|
| DE | 8501277 | 11/1988 |
| DE | 3800029 | 7/1989 |
| DE | 4024284 | 2/1992 |
| DE | 91 15 762 | 4/1992 |
| DE | 41 02 468 | 7/1992 |
| DE | 4137484 | 5/1993 |
| DE | 41 43 044 | 7/1993 |
| DE | 43 01 625 | 7/1994 |
| DE | 195 00 307 | 7/1996 |
| EP | 144009 | 11/1984 |
| EP | 188787 | 12/1985 |
| EP | 302 475 | 2/1989 |
| EP | 391117 | 10/1990 |
| EP | 567917 | 4/1993 |
| EP | 643 002 | 3/1995 |
| FR | 2 428 375 | 1/1980 |
| NL | 7 610 304 | 3/1978 |

* cited by examiner

Fig. 1
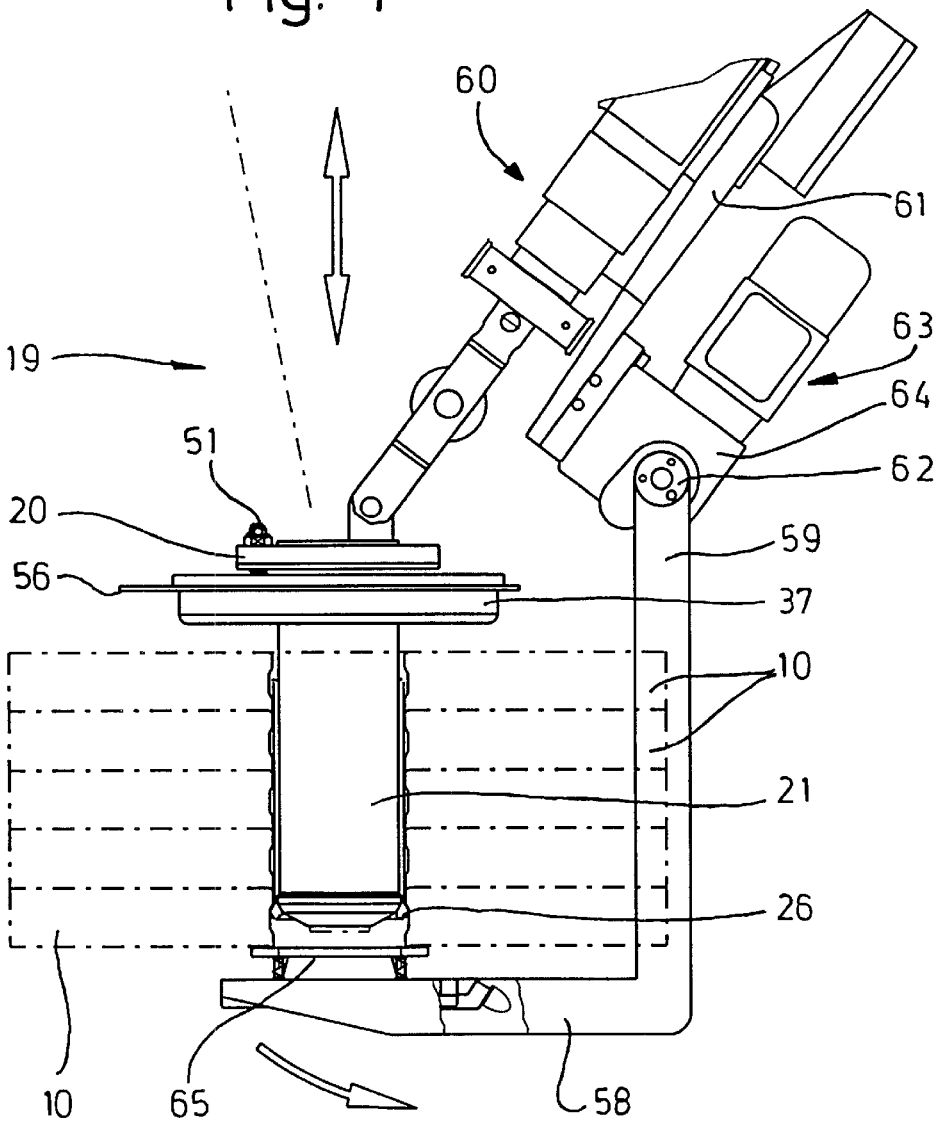
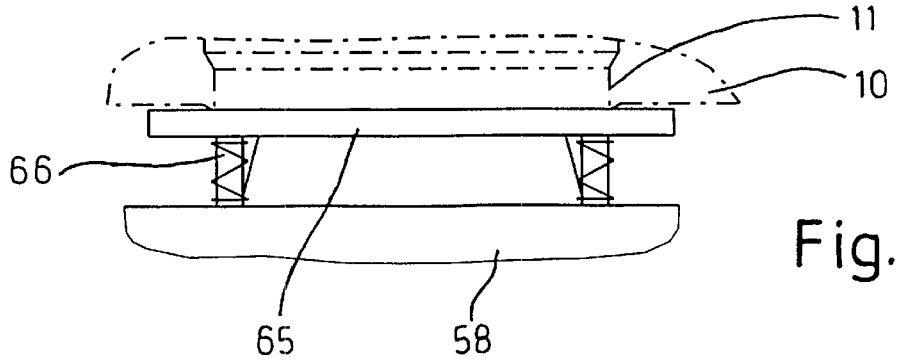
Fig. 2

APPARATUS FOR HANDLING REELS

BACKGROUND OF THE INVENTION

The invention relates to an apparatus for handling reels—wound material webs of, in particular, packaging material—having a central opening which is formed by a reel core and into which a bearing journal of a lifting and conveying unit enters.

With increasing efficiency of packaging machines, the handling of reels of packaging material is a particular problem, above all in the packaging of cigarettes. This problem also exists in the supply of cigarette paper to cigarette-making machines.

The reels, which are sometimes voluminous, are provided with an essentially cylindrical reel core which primarily consists of thick-wall cardboard.

To handle the reels and to hold them on packaging or other machines, cylindrical journals are known, which enter in an approximately fitting manner into the central opening in the reel core. Handling units which have a bearing journal to receive a reel and to transport the latter are also already known (U.S. Pat. No. 5,562 393).

SUMMARY OF THE INVENTION

The invention is based on the object of developing and improving a handling apparatus, in particular with a lifting and conveying unit for the reels, to the extent that the reels are held reliably and securely on a bearing journal during handling.

To achieve this object, according to the invention the bearing journal is anchored releasably in the opening in the reel in a non-positive and/or positive-locking manner.

The bearing journal is provided with holding or bearing members, in particular with clamping members or clamping jaws, which can be extended laterally. These come to rest in a non-positive manner and advantageously additionally in a positive-locking manner against the inner surface of the reel core in order to hold or fix the reel securely on the bearing journal. The clamping members are movable, namely retractable and extensible, the clamping members being retracted in the radial direction to remove a reel.

A particular feature of the invention lies in the fact that the reel cores, preferably consisting of a dimensionally stable material, such as plastic or metal, have one or more indentations on the inner side, in particular a groove running all around. Correspondingly configured members of the bearing journal, namely in particular movable clamping webs, enter into the said indentations to grip and hold a reel in a positive-locking manner. The reel is thus held securely, above all by a positive-locking engagement.

According to a further particular feature of the invention, the bearing journal of the lifting and conveying unit is dimensioned such that, in the axial direction, a plurality of reels can be gripped one above another or adjacently, e.g. reels of cigarette paper. In this case, the positive-locking connection of the movable members of the bearing journal to the correspondingly configured reel cores takes place expediently only in the region of the lower or end reel.

Moreover, an additional securement for the reels on the bearing journal is provided as a particular feature of the invention, specifically a movable, namely in particular pivotable, holding member which, when a bearing journal has received one or more reels, can be moved against the lower or outer reel, in which case it is possible for this additional holding member to rest against the lower or outer reel/reel core or to be positioned with spacing therefrom as a securement.

Further features of the invention relate to the refinement of the bearing journal and the lifting and conveying unit.

Exemplary embodiments are explained in greater detail below with reference to the drawings, in which:

BRIEF DESCRIPTION OF THE DRAWINGS

FIG. 1 shows a side view of a part of a lifting and conveying unit for reels;

FIG. 2 shows a detail of the unit according to FIG. 1 in a side view on an enlarged scale;

DESCRIPTION OF PREFERRED EMBODIMENTS

Figure 3:
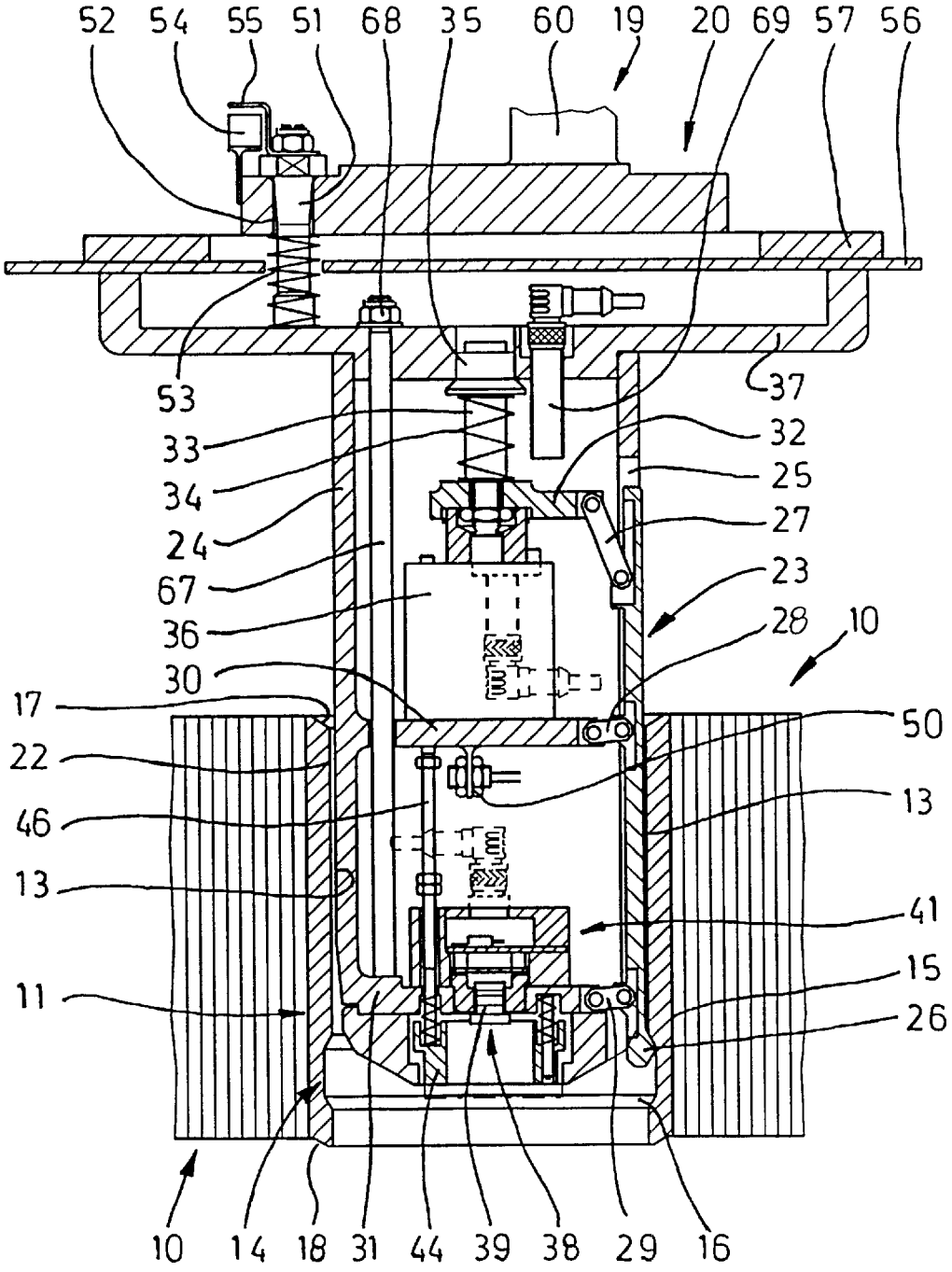
FIG. 3 shows a vertical section through a bearing journal in a reel.

The examples and details illustrated in the drawings relate to the handling of reels 10 from the field of cigarette technology. These reels 10 may be wound webs of packaging material, eg. tinfoil (FIG. 3). The reel 10 according to FIG. 3 consists of a double-width web. In contrast, FIG. 1 shows reels 10 which are comparatively narrow and consist, for example, of cigarette paper.

The reels 10 have a central reel core 11 in the middle. The latter may consist of a cellulose material. In the present exemplary embodiments, however, the reel cores 11 are made of a firm, rigid material, e.g. of plastic.

Figure 4:
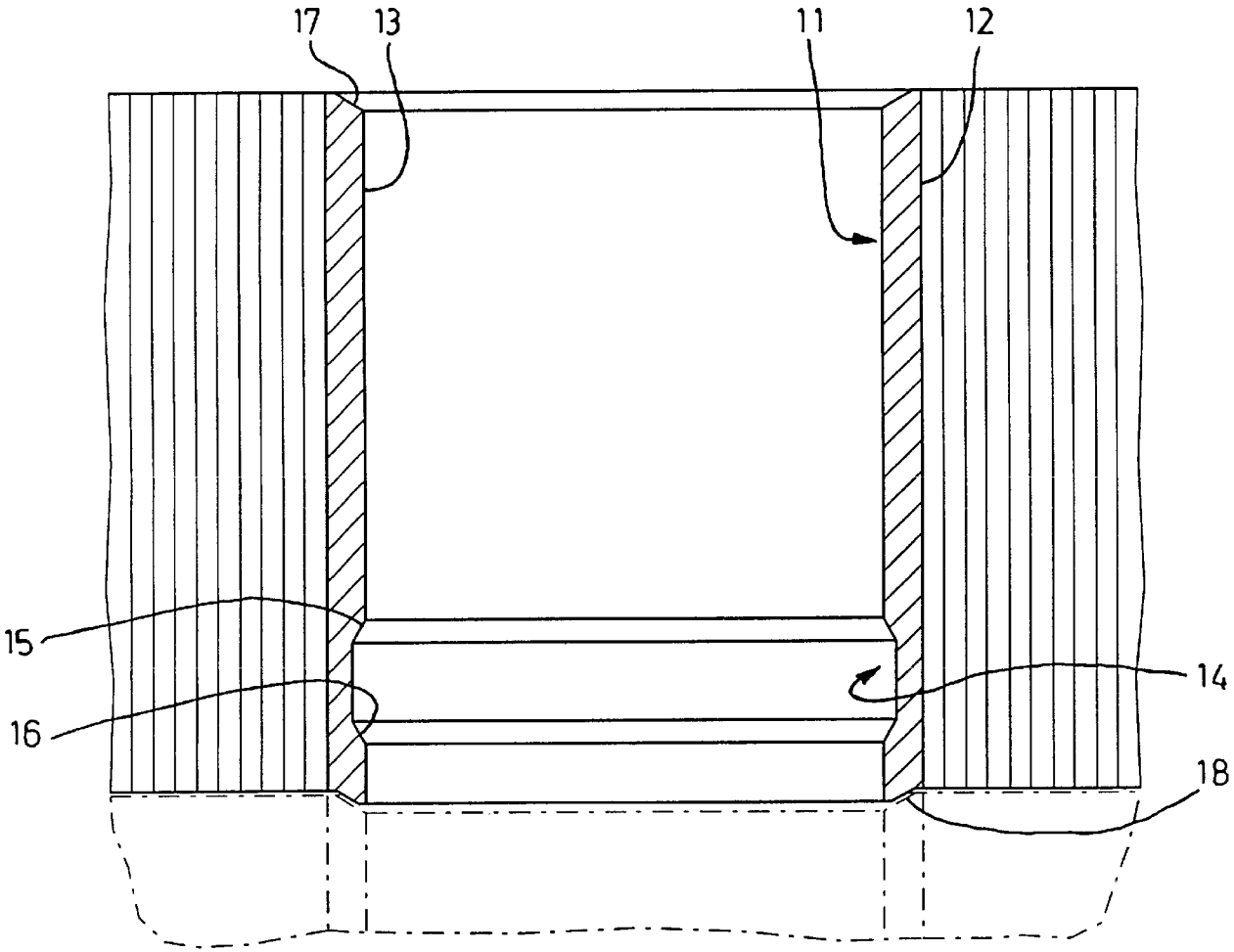
FIG. 4 shows a vertical section through an inner region of a reel on a greatly enlarged scale.

The cylindrical reel core 11 carries the wound web of material on its outer surface 12. A (cylindrical) inner surface 13 is provided with projections and/or indentations. In the exemplary embodiment according to FIG. 3 and FIG. 4, a groove 14, running all around, is formed in the lower region of the reel core 11 or adjacent to one end thereof and serves for the (positive-locking) attachment of gripping or holding members. Here the groove 14 is configured to be trapezoidal in cross-section with upper and lower sloping surfaces 15 and 16 running all around. Formed at an upper edge of the reel core 11 when the reel 10 is mounted appropriately is a conical, funnel-shaped end surface 17 which facilitates the introduction of holding members into the reel core 11. On the opposite side, a corresponding counter-surface 18 is formed as an edge limit of the reel core 11. The counter-surface 18 is part of a projection of the reel core 11 which protrudes beyond the region of the wound web and, when reels 10 arranged one above another are stacked, brings about automatic centring of the adjacent reels 10 in the region of the reel cores 11.

For handling, namely lifting and conveying reels 10, a handling unit 19 is provided. Here this is part of a movable conveyor (not shown), in particular an overhead conveyor which can be moved along high-level rail tracks of a factory building. Here the handling unit 19 comprises (three) telescopic arms 60 which diverge upwards and are attached at the bottom to a common bearing plate 20 in an articulated manner. Mounted (indirectly) on the latter, in turn, is a bearing journal 21 which is directed downwards for gripping single or multiple reels 10. The handling unit 19 is preferably configured in the manner described in U.S. Pat. No. 5,562 393.

To grip a reel 10 (or a plurality of reels 10 located one above another), the bearing journal 21 is introduced into a central opening 22 formed by the reel core 11. The essentially cylindrical bearing journal 21 is dimensioned such that the outside diameter is slightly smaller than the inside diameter of the opening 22.

The bearing journal 21 is anchored releasably inside the opening 22 or inside the reel core 11 in such a way that the reel 10 can be lifted up by the bearing journal 21. For this purpose, holding members can be extended laterally, that is to say in the transverse direction of the bearing journal 21, and form a non-positive and/or positive-locking connection with the reel core 11.

In the present exemplary embodiment, several (three) elongate clamping members, namely clamping webs 23, are provided along the circumference of the bearing journal 21. The clamping webs 23 are part of a cylindrical, tubular journal body 24 forming the bearing journal 21. The clamping webs 23 are each seated with slight play in upright slots 25 extending in the longitudinal direction of the bearing journal 21.

The elongate clamping webs 23 are extended transversely to grip a reel 10 so that they protrude beyond the outer surface of the journal body 24. As a result, the clamping web 23 comes to rest non-positively against the inner surface 13 of the reel core 11 in a/an (upper) region. Additionally, a positive-locking connection is provided between the clamping web 23 and the reel core 11. Laterally directed projections 26 of the clamping webs 23 enter in a positive-locking manner into the groove 14, in the present case resting against the upper sloping surface 15. The projections 26 are mounted at the lower ends of the clamping webs 23. To remove a transported reel 10, the clamping webs 23 are moved back inwards into a starting position in which they, including the projections 26, do not protrude beyond the contour of the bearing journal 21.

The actuation of the clamping webs 23 takes place from the interior of the hollow bearing journal 21. Each clamping web 23 is supported by a plurality of lugs 27, 28, 29 in the interior of the bearing journal 21. The lugs 27, 28 and 29, mounted in an articulated manner at each end, form a parallelogram connection which brings about parallel displacement of the clamping web 23 outwards or inwards.

The lower, comparatively short lugs 28, 29 are supported on transversely directed, inner intermediate walls 30, 31 of the bearing journal 21. The lugs 28 and 29 are dimensioned and positioned in such a way that, when a reel 10 is lifted up, a self-clamping effect is produced by the dead weight of the reel 10. As can be seen, in particular, from FIG. 3, for this purpose the lugs 28, 29 are inclined slightly at a very acute angle upwards from the inside to the outside in the bearing position, at least in such a way that the lugs 28, 29 cannot be moved beyond a dead centre position under the dead weight of the reel 10.

The upper lug 27 serves above all for actuation, namely extension and retraction of the clamping web 23. For this purpose, an actuating member is provided inside the bearing journal 21. For this purpose the (three) lugs 27 are arranged on a common actuator, namely on a pressure plate 32. The latter is located at the (lower) end of a piston rod 33 which, in turn, is displaceable in the axial direction, that is to say in the upward and downward direction, with the pressure plate 32. By moving the pressure plate 32 downwards, the (longer) lugs 27 are acted upon in a spreading manner with the result that the clamping webs 23 are moved outwards. Moving the pressure plate 32 upwards results in the opposite movement.

The pressure plate 32 can be acted upon by a pressure member to perform a downwardly directed spreading or actuating movement. In the present case, this is a (pretensioned) helical compression spring 34. The latter is positioned on the piston rod 33 and supported at the bottom on the pressure plate 32 and at the top on a fixed supporting bearing 35. The piston rod 33 can be moved in a sliding manner through the supporting bearing 35, namely when the compression spring 34 is compressed.

Consequently, the clamping webs 23 are moved into the spread position by the compression spring 34, that is to say by a member which is not dependent on an external supply of energy, in particular a pressure medium. A (pressure medium) cylinder 36, in particular a pneumatic cylinder, serves for the return movement into the starting position. The said cylinder is acted upon by compressed air in such a way that the pressure plate 32 is lifted up whilst compressing the compression spring 34, and the clamping webs 23 are thus moved back into the starting position.

A monitoring member, namely an initiator 69, is arranged in the region of an upper transverse wall 37 of the bearing journal 21 and projects in a specific relative position into the bearing journal 21 in such a way that an error signal is generated if, to receive a reel 10 and after release by the cylinder 36, the pressure plate 32 is not moved downwards by the compression spring 34, that is to say if there is an error with regard to the gripping of a reel 10.

The movement of the bearing journal 21 can be controlled automatically in such a way that the bearing journal 21 is aligned precisely with the opening 22 to receive a reel 10. For this purpose, a control unit is accommodated in the lower region of the bearing journal 21, namely in a lower chamber which is separated by the intermediate wall 30. The said control unit operates with a camera 38 whose lens 39 is positioned in the bearing journal 21 at the bottom or at the end. In the present exemplary embodiment, the lens 39 is seated in an indentation 40, which is open downwards, in the bearing journal 21.

During the operating movement of the handling unit 19, the camera 38 records the position of the reel 10 to be received. In this case, the camera 38 is expediently directed towards the image of the reel core 11. For this purpose, the latter may be marked in colour. The images recorded by the camera 38 are processed by means of an electronic unit 41 and fed via an electrical line 42 to a central evaluation unit outside the bearing journal 21. The line 22 is connected to the electronic unit 41 by means of a plug 43.

The apparatus or the bearing journal 21 is assigned a plurality of safeguarding members which rule out incorrect handling. In particular, these take into account any incorrect positions of the bearing journal 21 relative to the reel 10.

Arranged at the free or lower end of the bearing journal 21 is a mechanical scanning member which triggers an error signal in the event of the bearing journal 21 being in a position which is offset relative to the opening 22. The scanning member is an impact body 44 which is displaceable counter to elastic pressure relative to the bearing journal 21 in the axial direction thereof, that is to say into the bearing journal 21. The impact body 44 is of annular or cylindrical configuration and surrounds the indentation 40. The impact body 44 is supported by means of supporting springs 45 on the housing of the bearing journal 21, specifically on the lower intermediate wall 31. Several, namely three, guide rods 46, 47 serve to guide the impact body 44 and are distributed along the circumference of the impact body 44. The supporting springs 45 are seated on the guide rods 46, 47. These can slide in corresponding recesses in the impact body 44 so that the latter can be pushed into the indentation 40 with compression of the supporting springs 45 when the free end or the free edge of the impact body 44 is loaded.

In the starting position, the impact body 44 projects beyond the bearing journal 21. In this case, a shoulder 48 on the impact body 44 rests against a stop 49 on the bearing journal 21.

Figure 5:
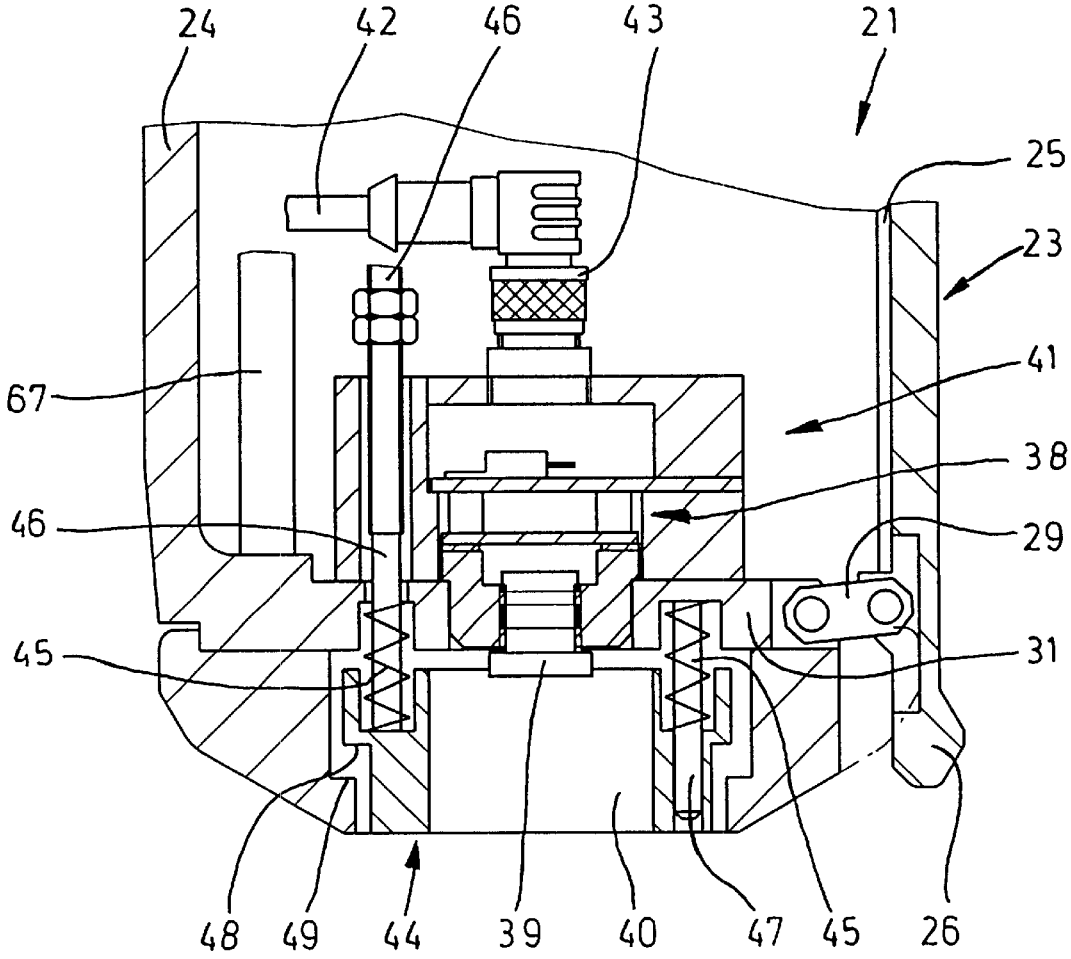
FIG. 5 shows a vertical section through a lower or end region of the bearing journal on an enlarged scale.
Figure 6:
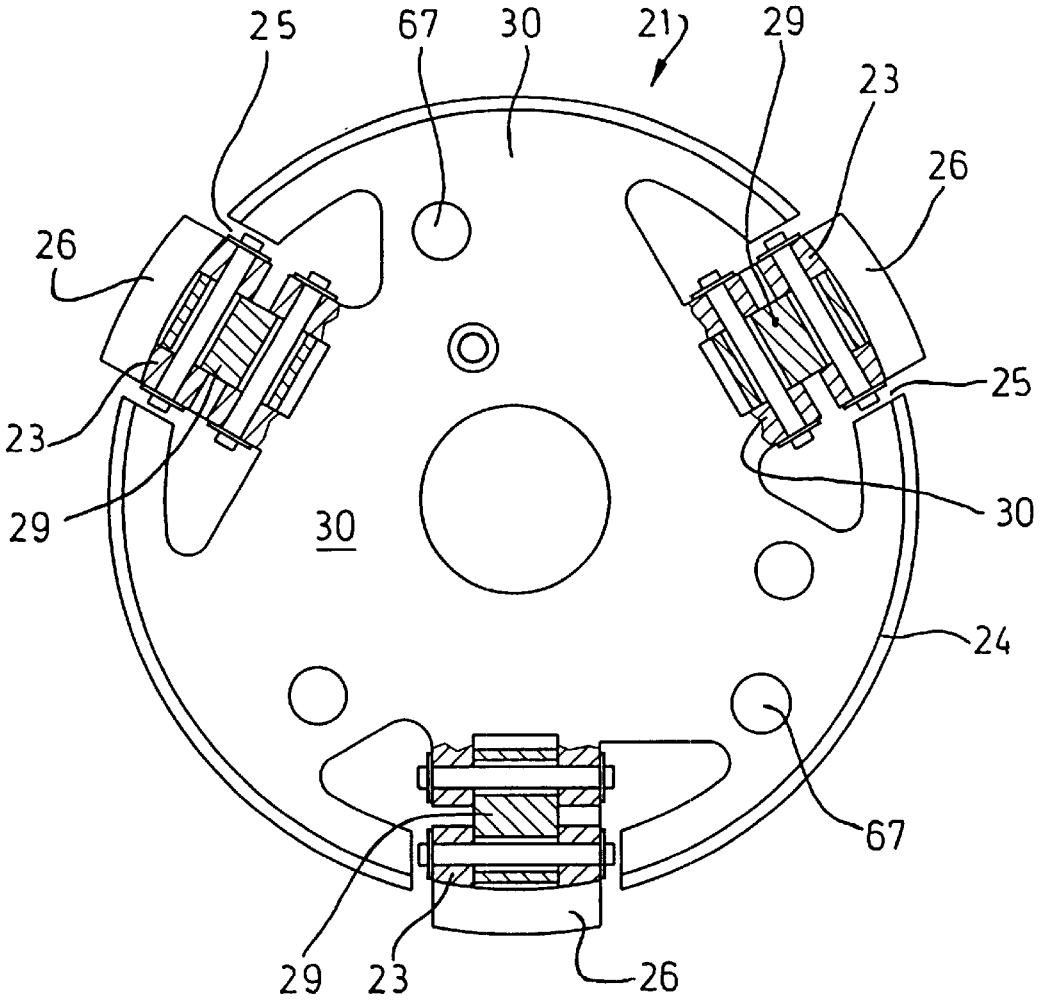
FIG. 6 shows a horizontal section through a bearing journal.

To generate an error signal, the guide rod 46 is extended upwards into the interior of the bearing journal 21 as actuating member. The guide rod 46 extends up to the intermediate wall 30. A contactless scanning member, namely an initiator 50, is arranged on the underside of the said intermediate wall. A thickening of the guide rod 46 interacts with the switching member or initiator 50 in such a way that a switching signal is generated during an upward movement into the position according to FIG. 3 or according to FIG. 5.

The bearing journal 21 is mounted so as to be movable in total on the handling unit 19. The upper transverse wall 37, configured in a pot-like manner, as part of the bearing journal 21 is mounted so as to be movable on the handling unit 19, namely on the bearing plate 20. The bearing journal 21 or the transverse wall 37 may assume a sloping position relative to the handling unit 19 or the bearing plate 20 due to the connection selected. As a result, an error signal is generated.

For this purpose, in the present example the transverse wall 37 is connected by means of bearing bolts 51 to the bearing plate 20. The bearing bolts 51 are connected fixedly to the transverse wall 37 at the bottom but, at the opposite end, are mounted so as to be displaceable in the longitudinal direction in corresponding bores 52 in the bearing plate 20. As a result, the bearing journal 21 can be lifted up—with the transverse wall 37—relative to the bearing plate 20, the bearing bolts 51 being displaced upwards in the bores 52. The normal position shown in FIG. 3 is secured by compression springs 53 which are supported on the transverse wall 37 on the one hand and on the bearing plate 20 on the other hand. Displacement of the bearing journal 21 relative to the holder or bearing plate 20 results in the actuation of a switching member, namely an initiator 54, which interacts with a switching lug 55 arranged on one of the bearing bolts 51.

The relative movement is bounded by a cover 56 on the top side of the transverse wall 37. Mounted on the cover 56 is a spacer ring 57 whose opening is larger than the outer circumference of the bearing plate 20, so that the latter can be inserted into the spacer ring 57 if the bearing journal 21 is fitted on incorrectly.

The bearing journal 21 is designed in such a way that, with corresponding dimensions, a plurality of reels 10 can also be received at the same time (FIG. 1). The bearing journal 21 enters into the common opening 22 formed by the reels 10 which are centred and test one above another in the present exemplary embodiment, the dimensions are such that, in the region of a lower reel 10 of the reel stack, the projections 26 of the clamping webs 23 enter into a groove 14 configured in the manner described. Of the multiplicity of reels 10, consequently only the lower one is gripped in a positive-locking manner, while those located above it are held non-positively by the clamping webs 23.

The handling unit 19 is provided as a further special feature with a/an (additional) safeguard in order to prevent the reels 10 from dropping off the bearing journal 21, which would be undesirable. For this purpose, a movable supporting member is provided, which is connected to the handling unit 19 and, when one or more reels 10 have been received by a bearing journal 21, can be moved against the underside of the reels 10 or against the free end of the bearing journal 21.

In the exemplary embodiment according to FIG. 1, a supporting limb 58 is provided, which is connected to the handling unit 19 by means of a pivoting arm 59, namely with a telescopic part 60. A holder 61 is mounted on the side of the telescopic part 60. On the said holder, the pivoting arm 59 is mounted in a pivot bearing 62. A motor 63 with a transmission 64 serves to carry out pivoting movements.

To support or secure the reels 10 on the bearing journal 21, the holding member, namely the supporting limb 58, is pivoted out of an upper starting position by means of the pivoting arm 59 into the position shown in FIG. 1 below the reels 10 or the bearing journal 21. If the reels 10 move downwards on the bearing journal 21, which would be undesirable, the supporting limb 58 prevents them from dropping off.

A further particular feature consists in the fact that a switching member is arranged on the supporting limb 58, which switching member triggers an error signal if the reels 10 drop onto the said switching member. In this case, it is an elastically mounted switching plate 65 which is arranged on the supporting limb 58 and is moved downwards counter to the pressure of springs 66 if a (lower) reel 10 or its reel core 11 acts upon the switching plate 65 as a result of an undesirable relative position or displacement on the bearing journal 21.

The apparatus described may be designed in an alternative manner. For instance, holding members may be mounted on the bearing journal 21, which engage on the underside of the reels 10 or the reel core 11 when the bearing journal 21 has been introduced into the opening 22. In this case, it is sensible or necessary to mount the reels 10 correspondingly, e.g. on a pallet, in such a way that the gripping members described can enter into a corresponding interstice below the reels 10 or the reel core 11. The reels 10 may be positioned on bases, namely mats, plates or the like, which have, in the region of the opening 22, an enlarged hole which provides the corresponding free space below the reel core 11.

What is claimed is:

1. An apparatus for handling a plurality of reels (10) of material webs of packaging material or cigarette paper, each reel being wound on an essentially cylindrical reel core (11) having a central opening (22) into which an elongate bearing journal (21) of a handling unit (19) downwardly enters to lift and transport the reel (10), said apparatus comprising:

a) means for releasably anchoring the bearing journal (21) in the opening (22) of the reel core (11) in a non-positive and a positive locking manner, b) said means comprising a plurality of elongate clamping webs (23) arranged along an outer circumference of the elongate bearing journal (21) at a distance from one another, and c) the elongate clamping webs (23) extending along the outer circumference of the elongate bearing journal (21) in the longitudinal direction thereof; and d) means for radially extending the clamping webs (23), in a direction parallel to the longitudinal axis of the elongate bearing journal (21), to grip the reel, said webs being pressed against an inner surface (13) of the reel core (11) in a clamping position in such a way that the clamping webs abut the inner surface (13) of the reel core (11) in a region extending within the opening (22), e) the clamping webs (23) having at least one outwardly directed radial projection (26) which enters a radial groove (14) in the inner surface (13) of the reel core (11).

2. The apparatus according to claim 1, further comprising:

a) a plurality of lugs (29) forming a parallelogram connection which mounts each clamping web (23) on the bearing journal, b) wherein the lugs (29) are mounted at one end thereof on the bearing journal (21) in articulated fashion and at another end thereof on the clamping web (23) in articulated fashion, and c) wherein the lugs (29) are arranged at an acute angle inclined upwards from an inside to an outside of the bearing journal when the clamping members are radially extended.

3. The apparatus according to claim 1, wherein:

said bearing journal is hollow and cylindrical, said means for extending comprises a pressure member (32) arranged within the hollow, cylindrical bearing journal (21), the pressure member (32) is movable downward for extending the clamping webs (23), and the pressure member (32) is connected to each clamping web (23) by an articulated lug (27) in such a way that the clamping webs (23) are moved in a radial outward direction by the lug (27) during a downward movement of the pressure member (32).

4. The apparatus according to claim 3, further comprising:

a compression spring (34) which loads the pressure member (32) in the direction of the outward movement of the clamping webs (23) in their extended positions, and a compression cylinder (36) which displaces the pressure member (32), into a retracted position against an exerted load of the compression spring (34) to move the clamping webs (23).

5. The apparatus according to claim 1, further comprising:

a) arranged at the free, lower end of the bearing journal (21), an impact body (44) serving as a scanning member, b) wherein the impact body (44) is centered on the bearing journal (21), is mounted in an indentation (40) thereof, and is displaceable in the axial direction;

c) supporting springs (45) supporting the impact body (44) on the bearing journal (21) in such a manner that in a normal position the impact body (44) projects beyond a free end of the bearing journal (21) and is moved into the indentation when pressure is applied to the supporting springs (45); and d) a switching member (50) which is actuated, by the impact body during the movement thereof into the indentation, to generate an error signal.

6. The apparatus according to claim 1, further comprising:

a) at a lower, free end of the bearing journal, a camera (3) for controlling the movements of the bearing journal, b) the camera (38) being attached in a centered indentation (40) formed at the lower end of the bearing journal (21); and c) a central evaluation unit connected to the camera (38).

7. The apparatus according to claim 1, wherein:

a) the elongate bearing journal (21) is configured, with respect to dimensions thereof in the longitudinal direction, for receiving a plurality of reels (10) vertically stacked on top of one another, b) the bearing journal downwardly enters the openings (22) of the stacked reels, and c) the radially extended clamping webs of the bearing journal (21) make a non-positive and a positive connection with at least the lowest reel (10) in the stack of reels.

8. The apparatus according to claim 7, wherein the stacked reels (10) are automatically centered on each other by a conical projection at one end of each reel core (11) and matching, corresponding indentations at an opposite end of each reel core (11), wherein adjacent reel cores (11) have self-adjusting end surfaces (17) and counter-surfaces (18) which rest against one another.

9. The apparatus according to claim 1, further comprising:

a) outer holding members which additionally hold the reels (10) on the bearing journal (21), b) wherein the holding members comprise a pivotable bearing bow which in a holding position lies against an underside of the bearing journal (21) or on an underside of the reel (10), with a transverse supporting limb (58), and c) wherein the bearing bow is connected to the handling unit (19).

* * * * *